United States Patent [19]

McKenna et al.

[11] 4,241,807

[45] Dec. 30, 1980

[54] STEP ATTACHMENT FOR LADDERS

[75] Inventors: Phillip McKenna, Crowley, La.; Arthur Penarowski, Aurora, Colo.

[73] Assignee: MacStep Co., Inc., Aurora, Colo.

[21] Appl. No.: 961,483

[22] Filed: Nov. 17, 1978

[51] Int. Cl.[3] ..... E06C 5/32; E06C 7/16

[52] U.S. Cl. ..... 182/121

[58] Field of Search ..... 182/121, 120, 122

[56] References Cited

U.S. PATENT DOCUMENTS

| | | | |
|---|---|---|---|
| 1,288,182 | 12/1918 | Pool | 182/121 |
| 1,462,086 | 7/1923 | Echlin | 182/121 |
| 1,920,552 | 8/1933 | Dollerhide | 182/121 |
| 2,419,727 | 4/1947 | Picone | 182/121 |
| 2,500,559 | 3/1950 | Miller | 182/121 |
| 2,948,349 | 8/1960 | Reddy | 182/121 |
| 3,067,836 | 12/1962 | Carnicelli | 182/121 |
| 3,503,468 | 3/1970 | Taylor | 182/121 |
| 3,511,338 | 5/1970 | Chapman | 182/121 |
| 3,552,523 | 1/1971 | Berkley | 182/121 |
| 3,899,045 | 8/1975 | Geisel | 182/121 |

FOREIGN PATENT DOCUMENTS

| | | | |
|---|---|---|---|
| 1363224 | 8/1974 | United Kingdom | 182/121 |

*Primary Examiner*—Reinaldo P. Machado
*Attorney, Agent, or Firm*—John E. Reilly

[57] ABSTRACT

A step attachment for conventional ladders includes two widened, horizontal steps, one in parallel, spaced-apart relation over the other, the forward edge of each step being positioned in the plane of the ladder and adapted for attachment to respective adjacent rungs of the ladder, and two substantially vertical support hangers pivotally and adjustably attached to the rear ends of the steps, the upper ends of which hangers are also positioned in the plane of the ladder and adapted for attachment to a rung of the ladder above the steps and to depend from the rung a sufficient distance downward to accommodate the pivotal, adjustable attachment of the steps to the hangers.

4 Claims, 6 Drawing Figures

STEP ATTACHMENT FOR LADDERS

BACKGROUND OF THE INVENTION

This invention relates to ladder attachments, and more specifically to a ladder attachment having a plurality of auxiliary widened steps for enlarging the effective step area of the rungs of the ladder.

Persons who spend extended periods of time on conventional ladders are familiar with the foot discomfort and fatigue caused by the narrow rungs of the ladder and the consequent relatively small area of contact between the person's feet and the rung of the ladder on which he is standing. In order to alleviate such discomfort, in the past various configurations and embodiments of attachments for ladders have been devised which provide one or more widened platforms or steps on which a person can stand to more evenly distribute the vertical force supporting the person over a larger area of the person's foot, and thereby decrease the concentration of pressure and resulting discomfort on the person's foot.

The following patents are typical of such ladder attachments which provide one enlarged step for the ladder: U.S. Pat. No. 1,288,182 issued to Pool; U.S. Pat. No. 1,462,086 issued to Echlin; U.S. Pat. No. 1,920,552 issued to Dollerhide; U.S. Pat. No. 2,419,727 issued to Picone; U.S. Pat. No. 2,500,559 issued to Miller; U.S. Pat. No. 3,511,338 issued to Chapman; U.S. Pat. No. 3,552,523 issued to Berkley; and U.S. Pat. No. 3,899,045 issued to Geisel. Several of the above-listed prior art patents include various adjustment means, including the Pool and Echlin patents which disclose means for adjusting the steps vertically in relation to the hanger means of the respective disclosures in those patents. Further, U.S. Pat. No. 2,948,439, issued to J. Reddy, and U.S. Pat. No. 3,504,468, issued to L. Taylor, both disclose ladder attachments having a plurality of widened step portions.

Although prior art devices are beneficial and successful to some extent in alleviating the foot strain problem, there has still remained a need for an improved ladder attachment device which provides more than one widened step, yet which is versatile, easy to attach and use, and, perhaps most important, stable and safe during use. For example, some of the attributes which such an attachment should possess include more than one step, a relatively rigid structure when attached to the ladder, no portion of the step protruding outwardly or forwardly beyond the plane of the ladder which could obstruct movement of a person's foot at it passes from one step to the other, or when his foot passes from a rung of the ladder to one or more additional steps, and it must be simple and convenient to attach to and detach from the ladder.

SUMMARY OF THE INVENTION

Accordingly, it is an object of the present invention to provide a safe device which can be conveniently attached to ladders for providing a plurality of steps or platforms of increased surface area on which a person can stand.

Another object of the present invention is to provide a step attachment device for ladders which is adjustable and conformabie to various angles of the ladder from vertical to maintain the steps in substantially horizontal orientation.

In a preferred embodiment of the present invention, a step attachment or apparatus is adapted for removable mounting on a ladder in which a pair of elongated, rigid frame members are disposed in substantially vertical, parallel, spaced-apart relation to each other, each of the frame members having hooks at its upper end for suspension from a rung in the ladder. A pair of horizontal step members are disposed between the frame members in vertically spaced relation to each other, each of the step members being of substantially the same length and width, and the vertical spacing between the step members approximating the distance between adjacent rungs on the ladder. Pivotal connections are provided for pivotally connecting the rearward ends of the step members to the vertical frame members, the pivotal connections being vertically adjustable upwardly and downwardly with respect to the frame members. In addition, each of the steps have rung attachment means on their forward ends which are pivotally connected at rearward ends to the vertical frame members, the rung attachment means being positioned in a common plane with each other and with the hooks on the frame members, and the rearward end of the upper of the step members being positioned and pivotally attached to the vertical frame members a spaced distance rearwardly of a plane extending through the hooks and through the rearward end of the lower of the step members.

Thus, auxiliary step attachment device according to the present invention includes two step members, each having a relatively large, flat, substantially horizontal surface adapted for attachment to a ladder for supporting a person thereon. The steps are spaced one over the other, the forward end of each being in a common plane with the ladder and removably attachable to adjacent rungs of the ladder. The hanger members depend downwardly, and the rear ends of the steps are pivotally attached in spaced-apart relation to the hanger members for support of the rear ends of the steps. The pivotal attachment of the steps to the hanger members is adjustable vertically to maintain a substantial horizontal orientation of the upper surface of the steps, regardless of the angle of the ladder to vertical.

DETAILED DESCRIPTION OF THE PREFERRED EMBODIMENT

Figure 2:
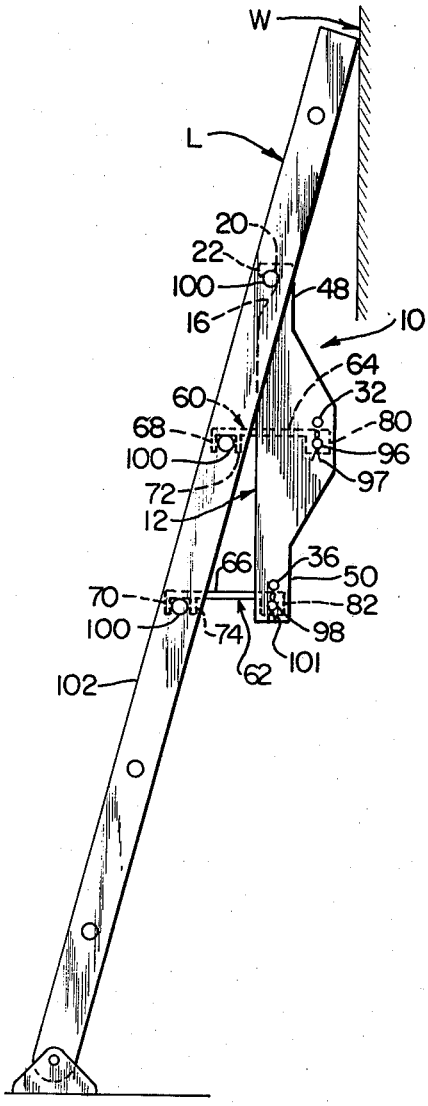
FIG. 2 is an elevation view of a ladder leaning against a wall with the step attachment device of the present invention secured thereon.

The step attachment device 10 according to the present invention is comprised of two step members 60, 62, each having a substantially flat, horizontal top surface 64, 66, respectively. The upper step member 60 is spaced upwardly and offset rearwardly from the lower step member 62. A pair of hanger members 12, 14 are positioned substantially vertically in parallel spaced-apart relation to each other on opposite sides of the step members 60, 62. The upper step 60 is pivotally attached to and supported by the hanger members 12, 14 by a transverse rod or shaft 96, and lower step 62 is likewise pivotally attached to and supported by the hanger members 12, 14 by a transverse rod or shaft 98.

The upper step 60 has a flat, substantially horizontal top surface 64 adapted to accommodate a person standing thereon. An ear 80 extends downwardly from the right rear corner of the step 60, and another ear 84 extends downwardly from the left rear corner of the step 60. The ear 80 has a transverse hole 88 extending therethrough, and the ear 84 has a similar hole 92 extending transversely therethrough in axial alignment with the hole 88. The step 60 also includes a forward lip 68 extending downwardly from its forward edge. An additional shorter bottom lip 72 extends downwardly from the undersurface of the step a spaced distance rearwardly of the forward lip 68 on the right side of step 60, and a similar short bottom lip 76 extends downwardly from the undersurface of the step 60 a spaced distance rearwardly of the forward lip 68 on the left side of the step 60. The distance between bottom lips 72, 76 and the forward lip 68 is sufficient to accommodate the rung of a ladder positioned therebetween such that said lips 68, 72, 76 are adapted to removably secure the front edge of the step 60 to the rung of a ladder.

The lower step 62 has a flat, substantially horizontal top surface 66. An ear 82 extends downwardly from the right rear corner of the step 62, and another ear 86 extends downwardly from the left rear corner of the step 62. The ear 82 has a transverse hole 90 extending therethrough, and the ear 86 has a similar hole 94 extending transversely therethrough in axial alignment with hole 90. The step 62 also includes a forward lip 70 extending downwardly from its forward edge. An additional shorter bottom lip 74 extends downwardly from the undersurface of the step 62 a spaced distance rearwardly of the forward lip 70 on the right side of step 62, and a similar short bottom lip 78 extends downwardly from the undersurface of the step 62 a spaced distance rearwardly of the forward lip 70 on the left side of the step 62. The distance between bottom lips 74, 78 and the forward lip 70 is sufficient to accommodate the rung of a ladder therebetween such that said lips 70, 74, 78 are adapted to removably secure the front edge of the step 62 to the rung of a ladder.

The right hanger member 12 is an elongated, substantially vertical plate positioned along the right side of the steps 60, 62, and having a widened mid portion 52 tapering into a narrower upper portion 48 and into a similar narrow lower portion 50. Likewise, the left hanger member 14 is an elongated, substantially vertical plate positioned along the left side of the steps 60, 62, and having a widened mid portioned 58 tapering into a narrower upper portion 54 and into a similar narrow lower portion 56.

Hanger member 12 has a hole 34 extending transversely through its mid portion 52, and another hole 38 extending transversely through its lower portion 50. Likewise, left hanger member 14 has a hole 42 extending transversely through its mid portion 58, and another hole 46 extending transversely through its lower portion 56. The holes 34, 42 are axially aligned with holes 88, 92 in step 60, and the shaft 96 extends through said holes 34, 42, 88, 92 to pivotally attach the step 60 to the frame members 12, 14. The shaft 96 is retained in position by its head 95 on one end and by a removable pin 97 on the other end. The holes 38, 46 are axially aligned with holes 90, 94 in step 62, and the shaft 98 extends through said holes 38, 46, 90, 94 to pivotally attach the step 62 to the frame members 12, 14. The shaft 98 is retained in position by its head 99 on one end, and by a removable pin 101 on the other end.

The hanger member 12 also has a hook-shaped notch 16 extending upwardly and inwardly into its upper portion 48 and terminating in a downwardly opening recess 20 having a finger 22 extending downwardly over the front of the recess 20 in the form of a hook. The hanger member 14 also has a hook-shaped notch 24 extending upwardly and inwardly into the upper portion 54 and terminating in a downwardly opening recess 28 having a finger 30 extending downwardly over the front of the recess 28 in the form of a hook.

Figure 1:
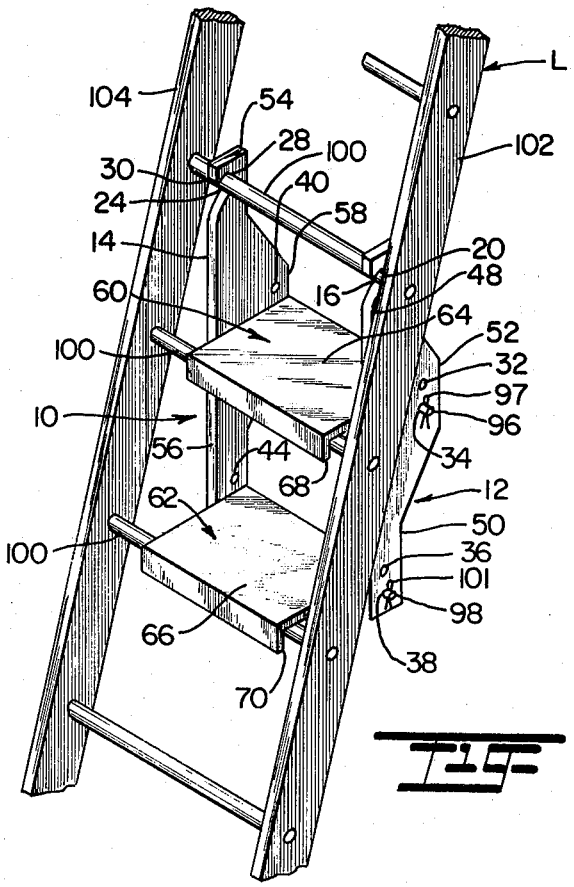
FIG. 1 is a perspective view of a segment of a conventional ladder with the step attachment device of the present invention positioned thereon.
Figure 4:
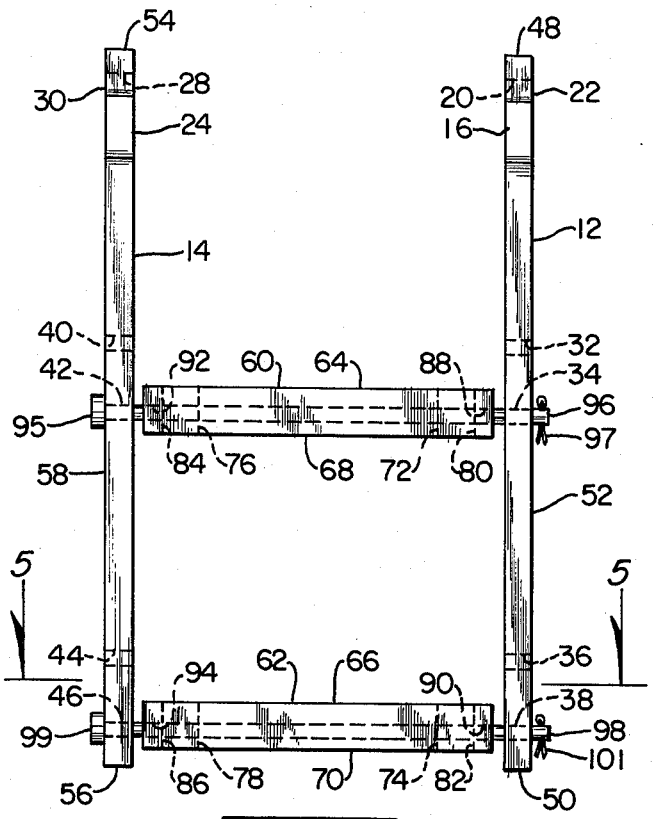
FIG. 4 is a front elevation view of the step attachment of the present invention.
Figure 5:
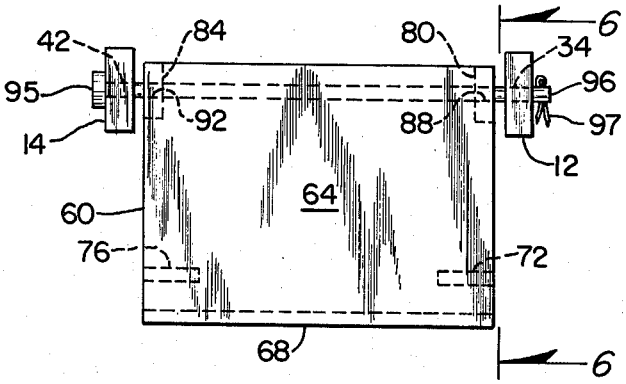
FIG. 5 is a plan view of the step attachment device.
Figure 6:
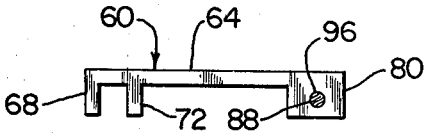
FIG. 6 is an elevation view of a step member for the device.

The attachment of the auxiliary step apparatus 10 of this invention to a ladder L is best seen in FIGS. 1 and 2, wherein a conventional ladder L is shown comprised of a pair of elongated parallel, spaced-apart side members 102, 104 with a plurality of rungs 100 extending therebetween transverse to said side members 102, 104 in parallel, spaced-apart relation to each other. The hanger members 12, 14 are suspended from a rung 100 of a ladder by positioning the respective notches 16, 24 over the rung 100 with the rung securely seated in the recesses 20, 28 and retained on the rung by the finger 22, 30 extending downwardly over the side of the rung 100. The step 60 is removably secured to the next lower rung 100 by positioning the forward lip 68 and bottom lips 72, 76 on opposite sides of the rung. Likewise, the lower step 62 is removably secured to another next lower rung 100 by positioning the forward lip 70 and bottom lips 74, 78 on opposite sides of the rung 100.

When the ladder L is in a normal position leaning against an object such as a wall W, as shown in FIG. 2, the hanger members 12, 14 depend substantially vertically downwardly, and the top surfaces 64, 66 of the steps 60, 62, respectively, are substantially horizontal. In that position, with the hanger members and steps securely attached to the rungs of the ladder as described above, a person can stand on the top surfaces 64, 66 of the steps 60, 62 with relative safety and comfort, the steps being supported on the forward ends by the rungs of the ladder and on the rearward ends by the hanger members. It is significant to note that the notched portions 16, 24 of the upper portions 48, 54 of the hangers, and the forward portions of the step are all positioned in a common plane with the rungs of the ladder, and the steps do not protrude forwardly of the plane in order not to interfere with movement of a person's feet upwardly and downwardly from one rung on the ladder to the next. Since the steps 60, 62 are substantially the same size as each other, the hole 34 in the widened mid portion 52 of the hanger member 12 and the hole 42 in the widened mid portion 58 of hanger member 14 are offset rearwardly from a plane extending through the notches 16, 24 in the upper ends 48, 54 and the hole 38, 46 in the lower portions 50, 56, in order to accommodate attachment of the front portion of step 60 to the rung 100 of the ladder in a common plane with the notch portion 16, 24 and the forward end of step 62.

Figure 3:
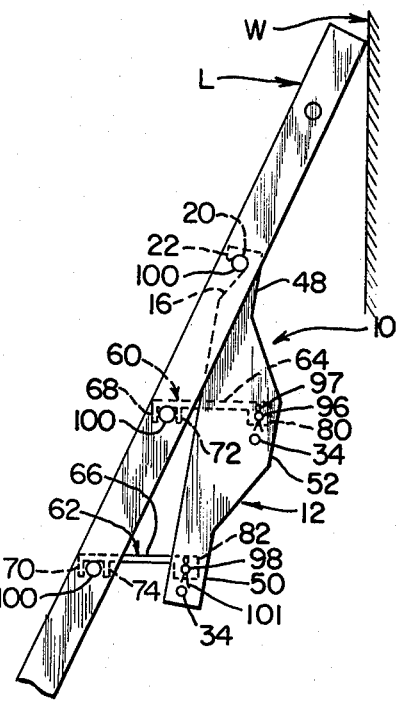
FIG. 3 is a segment of a ladder in elevation leaning against a wall at an increased angle with the step device of the present invention secured thereon and adjusted to accommodate the greater angle.

Alternatively, when the ladder L is positioned against a wall W at a wider angle to the wall, as shown in FIG. 3, the steps 60, 62 would tend to slope from the horizontal if attached as described above. Therefore, in order to maintain the steps 60, 62 in substantially horizontal position when the ladder is leaned against a wall W at a wider angle, the hanger members 12, 14 are provided with an alternative set of holes to adjust the rearward ends of the steps 60, 62 upwardly. These auxiliary or alternative holes include hole 32 through the mid portion 52 of hanger member 12 a spaced distance upwardly from hole 34, and a hole 40 through the mid portion 58 of hanger member 14 a spaced distance upwardly from hole 42 and alignment axially with hole 32. Also, hole 36 extends through the lower portion 50 of hanger member 12 a spaced distance upwardly from hole 38, and a similar hole 44 extends through the lower portion 56 of hanger member 14 a spaced distance upwardly from hole 46 and in axial alignment with hole 36. Therefore, the shaft 96 can be removed from its normal position in holes 34 and 42 and repositioned upwardly into holes 32, 40 to adjustably support the rear portion of the step 60. Similarly, the shaft 98 can be removed from its normal position in holes 38 and 46 and repositioned upwardly into holes 36, 44 to adjustably support the rear portion of step 62.

It can be appreciated therefore that the step attachment device 10 of the present invention is adapted to be easily positioned on a conventional ladder where it can be secured in a relatively stable, rigid manner to provide widened steps for a person standing on the ladder in a manner such that there is no protrusion of the steps forwardly of the rungs of the ladder to trip or interfere with the movement of the person's feet up and down from one rung to the next. The invention also has a vertically adjustable, pivotal attachment of the rearward portion of the steps 60, 62 to the hanger members 12, 14 to accommodate wider angles of the ladder to a wall while still maintaining the steps 60, 62 in safe, secure and relatively horizontal position.

The ladder attachment device 10 of the present invention is also effective in enhancing the stability and safety of a ladder L to which it is attached by distributing the weight of a person over several rungs of the ladder rather than concentrating the weight on one rung. Also, a substantial portion of the person's weight is distributed to the rung from which the hanger members 12, 14 are suspended, which is one or two rungs above the level of the person's feet. This shift in location of the weight force upwardly closer to the upper end of the ladder L results in a decreased moment arm between the upper end of the ladder L (which rests against the wall W); therefore, the magnitude of the moment to be resisted by the side members 102, 104 is decreased.

Although the present invention has been described with a certain degree of particularity, it is understood that the present disclosure has been made by way of example and that changes in details of structure may be made without departing from the spirit thereof.

What is claimed is:

1. Step apparatus adapted for removable mounting on a ladder, comprising:

a pair of elongated, rigid frame members disposed in substantially vertical parallel, spaced-apart relation to one another, each of said frame members having hook means at its upper end adapted for suspending said frame members from a rung in the ladder; and two horizontal step members disposed between said frame members in vertically spaced relation to each other, each of said step members being substantially the same length and width as the other, the vertical spacing between said step members being approximately equal to the distance between adjacent rungs on the ladder, and pivotal connection means for pivotally connecting the rearward ends of said step members to said vertical frame members, said pivotal connection means being vertically adjustable upwardly and downwardly with respect to said frame members, each of said steps having rung attachment means on the forward end thereof and being pivotally connected at their rearward ends to said vertical frame members with rung attachment means at the forward ends of said step members positioned in a common plane with each other and with the hook means on said frame members and the rearward end of the upper of said step members positioned and pivotally attached to said vertical frame members a spaced distance rearwardly of a plane extending through said hook means and through the rearward end of the lower of said step members.

2. The step apparatus of claim 1, wherein each of said vertical frame members has a widened midportion, said pivotal connection means for the lower of said step members includes the lower portion of each of said frame members with a plurality of holes therein arranged along a substantially vertical line, the rearward end of said lower step member with a transverse hole therethrough, and an elongated pin removable extending through a selected one of said holes in one frame member, through said hole in said lower step member, and through a selected one of said holes in the other frame member corresponding with the selected one of said holes in said one frame member, and said pivotal connection means for the upper of said step members includes the widened midportion of each of said frame members with a plurality of holes therein arranged along a substantially vertical line spaced rearwardly from a straight line extending through said hook means and through said connection means for the lower of said step members, the rearward end of the upper step member with a transverse hole therethrough, and an elongated pin removably extending through a selected one of said holes in one frame member, through said hole in said upper step member, and through a selected one of said holes in the other frame member corresponding with the selected one of said holes in said one frame member.

3. An auxiliary step device adapted for attachment to a ladder, comprising:

an upper step member 60 having a substantially flat upper surface 64, a forward lip 68 extending downwardly from the front edge of said upper step member 60, a bottom lip 72 extending downwardly from the undersurface of said upper step member 60 in parallel, rearwardly spaced relation to said forward lip 68, a right ear 80 with a transverse hole 88 therethrough extending downwardly from the right rear corner of said upper step member 60, and a left ear 84 with a transverse hole 92 therethrough extending downwardly from the left rear corner of said upper step member 60, said holes 88, 92 being in axial alignment with each other;

a lower step member 62 having a flat upper surface 66 and being of substantially the same size and dimensions as said upper step member 60, said lower step member also having a forward lip 70 extending downwardly from the front edge of said upper step member 62, a bottom lip 74 extending downwardly from the undersurface of said lower step member 60 in parallel, rearwardly spaced relation to said forward lip 70, a right ear 82 with a transverse hole 90 therethrough extending downwardly from the right rear corner of said lower step member 62, and a left ear 86 with a transverse hole 94 therethrough extending downwardly from the left rear corner of said lower step member 62, said holes 90, 94 being in axial alignment with each other;

a right hanger member 12 having a narrow upper end portion 48, a rearwardly widened mid portion 52, and a narrow lower end portion 50, said right hanger member 12 having a hook-shaped notch 16 with a downwardly opening recess 20 therein and a downwardly extending finger portion 20 over the front of the recess 20, said notch 16 being adapted for attachment on a rung of a ladder, and two transverse holes 34, 38 through said right hanger member 12, said hole 38 being positioned in said lower end portion 50, and said hole 34 being positioned in said mid portion a spaced distance rearwardly of a straight line extending through said notch 16 and said hole 38;

a left hanger member 14 having a narrow upper end portion 54, a rearwardly widened mid portion 58, and a narrow lower end portion 56, said upper end portion 54, mid portion 58, and lower end portion 56 all being substantially the same size and configuration as said corresponding upper end portion 58, mid portion 52, and lower end portion 50 of said right hanger member 12, said left hanger member 14 also having a hook-shaped notch 24 with a downwardly opening recess 28 therein and a downwardly extending finger portion 30 over the front of the recess, 28, said notch 24 being adapted for attachment on a rung of a ladder, and two transverse holes 42, 46 through said left hanger member 14, said hole 46 being positioned in said lower end portion 56, and said hole 42 being positioned in said mid portion a spaced distance rearwardly of a straight line extending through said notch 24 and said hole 46;

an elongated lower shaft 98 for pivotally connecting the rear end of said lower step member 62 to said right hanger member 12 and to said left hanger member 14, said lower step member 62 being positioned with its top surface 66 substantially horizontal, said right hanger member 12 being positioned substantially vertically adjacent the right rear portion of said lower step member 62, and said left hanger member 14 being positioned substantially vertically adjacent the left rear portion of said lower step member 62 with said holes 90, 94, 38, 46 all in axial alignment with each other, said lower shaft 98 being inserted through all of said holes 90, 94, 38, 46, and the forward portion of said lower step member 62 extending forwardly of said left and right hanger members; and an elongated upper shaft 96 for pivotally connecting the rear end of said upper step member 60 to said right hanger member 12 and to said left hanger member 14, said upper step member being positioned midway between said notches 16, 24 and said lower step member 62 and offset rearwardly in relation to said lower step member 62 a sufficient distance that the forward end of upper step member 60 lays in a common plane with said notches 16, 24 and the forward end of said lower step member 62, and the rearward end of said upper step member being positioned between the mid portions 52, 58 of said right and left hanger members 12, 14 respectively, with said holes 88, 92, 34, 42 all in axial alignment with each other, and said upper shaft 96 being inserted through all of said holes 88, 92, 34, 42.

4. The auxiliary step device of claim 3, including an additional set of holes 32, 40 in said mid portions 52, 58 of said right and left hanger members 12, 14 respectively, said hole 32 being a spaced distance vertically above said hole 34, and said hole 40 being a spaced distance vertically above said hole 42 and in axial alignment with said hole 32 to receive said shaft 96, the pivotal attachment of said upper step member 60 to said right and left hanger members 12, 14 being adapted for upward and downward adjustment by selectively positioning said shaft in said holes 88, 92, 34, 42 or in said holes 88, 92, 32, 40, and also including an additional set of holes 36, 44 in said lower portions 50, 56 of said right and left hanger members 12, 14 respectively, said hole 36 being a spaced distance vertically above said hole 38, and said hole 44 being a spaced distance vertically above said hole 46 and in axial alignment with hole 36 to receive said shaft 98, the pivotal attachment of said lower step member 62 to said right and left hanger members 12, 14 being adapted for upward and downward adjustment by selectively positioning said shaft in said holes 90, 94, 38, 46 or in said holes 90, 94, 36, 44.

* * * * *

UNITED STATES PATENT AND TRADEMARK OFFICE

CERTIFICATE OF CORRECTION

PATENT NO. : 4,241,807

DATED : December 30, 1980

INVENTOR(S) : Phillip McKenna et al

It is certified that error appears in the above—identified patent and that said Letters Patent is hereby corrected as shown below:

Column 3, line 57, cancel "portioned" and substitute -- portion --.

IN THE CLAIMS:

Claim 3, Column 7, line 29, cancel "58" and substitute -- 48 --.

Signed and Sealed this

*Sixteenth* Day of *June 1981*

[SEAL]

*Attest:*

RENE D. TEGTMEYER

*Attesting Officer*

*Acting Commissioner of Patents and Trademarks*